United States Patent [19]

Leonhart

[11] 4,170,353

[45] Oct. 9, 1979

[54] TABLE FOOTBALL GAME WITH ACTUATING RODS

[76] Inventor: Xaver F. Leonhart, 8381 Harburg near Pilsting, Ndb., Fed. Rep. of Germany

[21] Appl. No.: 839,209

[22] Filed: Oct. 4, 1977

[30] Foreign Application Priority Data

Oct. 9, 1976 [DE] Fed. Rep. of Germany ..... 2645741

[51] Int. Cl.[2] ..... A63F 7/06

[52] U.S. Cl. ..... 273/85 D

[58] Field of Search ..... 273/85 D, 85 B

[56] References Cited

FOREIGN PATENT DOCUMENTS

| | | | |
|---|---|---|---|
| 512456 | 7/1952 | Belgium | 273/85 D |
| 510462 | 3/1955 | Canada | 273/85 B |
| 511374 | 1/1955 | Italy | 273/85 D |
| 1333073 | 10/1973 | United Kingdom | 273/85 D |

*Primary Examiner*—George J. Marlo
*Attorney, Agent, or Firm*—Brady, O'Boyle & Gates

[57] ABSTRACT

A supported playing field having a pair of guide rods connected along opposite sides of the playing field in the area of the playing zones at opposite ends of the field. A slide carriage mounted for movement along the guide rods consisting of a pair of sleeve bearings longitudinally displaceable along the guide rods, and interconnected by a brace extending beneath the playing field, with the slide carriage supporting bearings at right angles on the sleeve bearings which engage and support at opposite ends at least one actuating rod extending across and above the playing field, which in turn supports dummy player pieces which can be moved to propel a ball on the table by moving the slide carriage back and forth, rotating the actuating rod about its axis, and/or moving the actuating rod axially.

7 Claims, 2 Drawing Figures

TABLE FOOTBALL GAME WITH ACTUATING RODS

BACKGROUND OF THE INVENTION

The present invention relates to a table football game with actuating rods carrying player pieces, by means of which all the ways of playing the ball on the field of a real football game can be imitated on the playing field of the table football game.

In the table football game with actuating rods disclosed in Swiss Pat. No. 197,003, the spaces between the rods are so arranged that the ball can only be reached when it is disposed at any location in the playing zone except midway between two adjacent rods in the playing field. When the ball is in this middle position, midway between two adjacent actuating rods, the players must manually move the ball into a different position so that it can again be reached and played by the dummy player pieces on the actuating rods. Accordingly, table football games with actuating rods cannot be covered by a protective sheet of glass and because of this the players are free to steal the ball or, instead of inserting a coin in the device provided for that purpose, can play without paying for the game by using their own ball. According to the above Swiss patent, this disadvantage is obviated by ensuring that the actuating rods and the height of the dummy playing figures on the rods are selected in such a way that the ball cannot occupy a dead spot in the playing field. However, if the dummy player pieces are not to touch one another in their horizontal positions, the largest radius of movement which the figures can describe about the center axes of the actuating rods must be so small that the ball can no longer be displaced at the desired speed because of lack of leverage. In addition, the rods are disposed so close to one another that they obstruct the movements of the players' two hands on the handles of the actuating rods.

SUMMARY OF THE INVENTION

The object of the present invention is to provide a table football game with actuating rods which allows the ball to be moved freely in all directions of the playing zone under a covering glass panel and also enable the football to be moved with approximately the same momentum as the ball in a real football game.

According to the invention, this problem is solved by having the bearings of the actuating rods form part of a guide frame or slide frame which enables the actuating rods to be freely moved parallel to one another and to the playing field and in a direction longitudinally of the playing field.

With rods which are movable parallel to one another and to the playing field, running shots and passing action similar to an actual football game are made possible without considerably increasing the cost of existing games of this type.

An embodiment of a table football game with actuating rods according to the invention, is comprised of two guide rods, positioned on opposite sides of the game table and the ends of which are connected to the head end of the playing table in such a way that the guide rods extend freely along the outer longitudinal sides of the table parallel to one another and to the playing field, and by a pair of sleeve bearings positioned on opposite sides of the game table and which are longitudinally displaceable along the guide rods, the sleeves being rigidly connected to one another beneath the playing surface so they move as a unit, with each sleeve carrying upwardly projecting short guides disposed at right angles thereto and forming bearing mounts for moveable actuating rods extending between the pair of sleeves and projecting through longitudinal slots in the side walls of the table. Such guide frame arrangement of guide rods, sleeve bearings and actuating rods is provided at each end of the table. The playing, or actuating rods are preferably spaced further apart from one another than the radius of movement of the dummy player pieces about the longitudinal axes of the rods.

It has proved advantageous to mount only two actuating rods on each pair of sleeve bearings as the rods can be moved especially rapidly towards the ball when both rods are simultaneously gripped with the hands. This solution enables considerable space to be saved by arranging the table game with one longitudinal side adjacent to a wall and by providing only two actuating rods for each player, that is two actuating rods at each end of the table, without restricting the game by comparison with the actual football game with the exception of a reduced number of players.

BRIEF DESCRIPTION OF THE DRAWINGS

Other objects, features and advantages of the present invention will be made apparent in the following description of an embodiment thereof provided in reference to the accompanying drawings, in which.

DESCRIPTION OF THE PREFERRED EMBODIMENT

Figure 1:
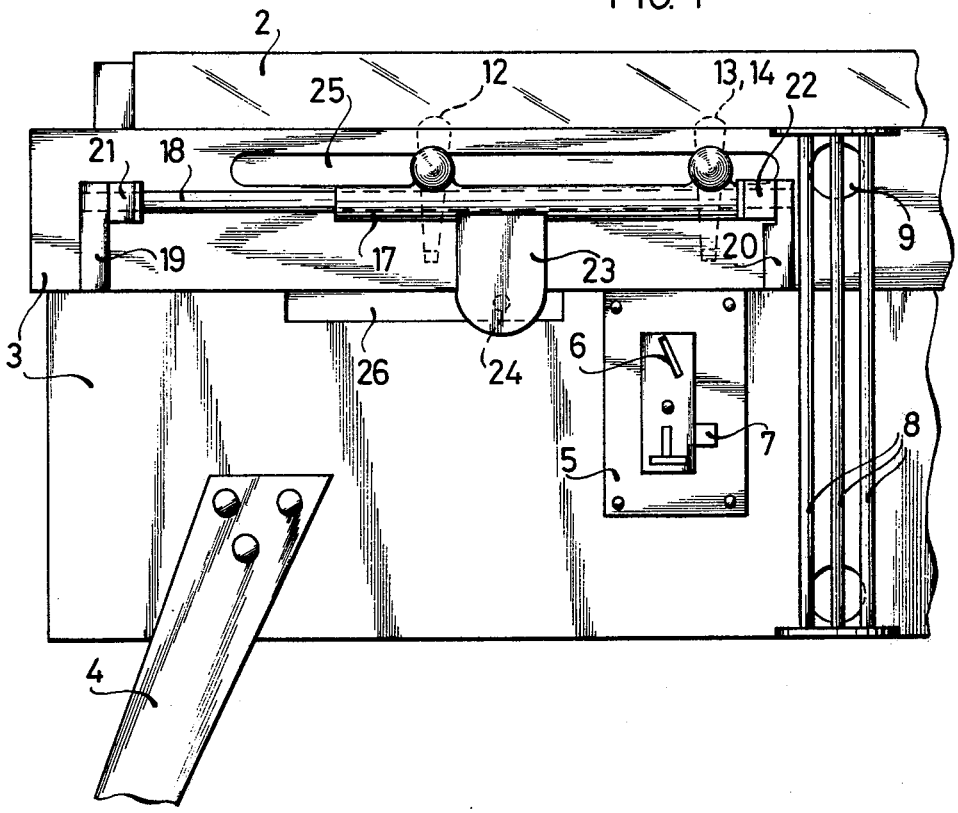
FIG. 1 is a fragmentary side elevational view of the left upper half of a table football game according to the invention.
Figure 2:
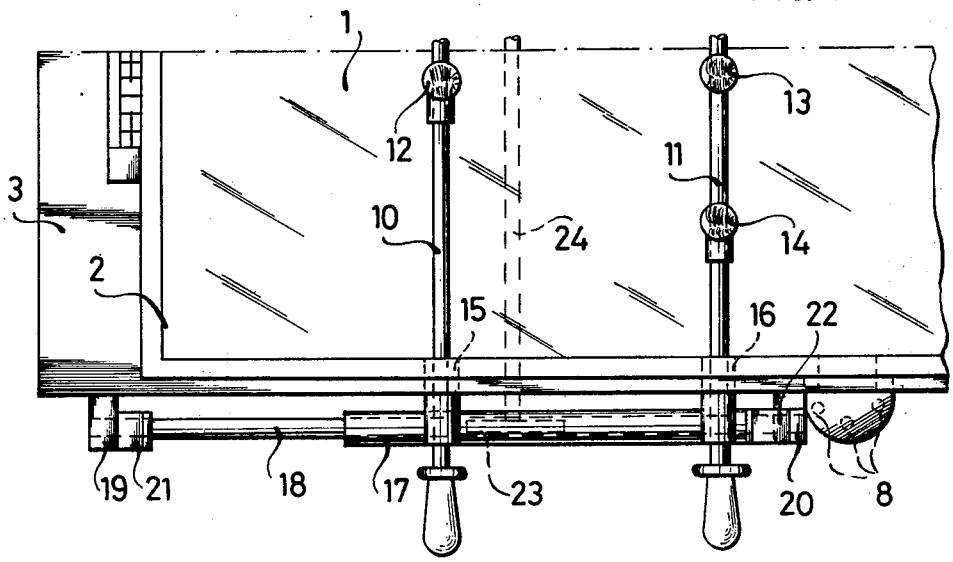
FIG. 2 is a top plan view of the left forward quarter of the table game, it being understood that the left rear quarter being substantially identical and the right end of the table being substantially a mirror image.

The table football game with actuating rods according to the invention consists of a playing field 1, within a case 3, with the top of the case and the playing field covered by a protective glass panel 2 and the case 3 having supporting legs 4. A coin checking and game control device 5 comprising a coin insertion slot 6 and release rod 7 is connected in the case 3 in the usual manner and functions to ensure that after the player has isnerted the requisite number and type of coins in the slot 6, and has pulled on the release rod 7, a ball is provided behind the three ball guard rods 8 which are disposed approximately in the middle of the playing field and at its side. The player then lifts the ball with his fingers throught the ball guard rods 8 and moves it upwardly within the guard rods and into play on the playing field 1 via an opening 9 at the top of the rods 8.

Laterally guided actuating rods 10 and 11, carrying dummy player pieces 12, 13 and 14 therein at selected spacings, intermediate the ends thereof and in the playing zone of the playing field 1, are mounted for displacement in an axial direction and rotation about their longitudinal axes, over the playing field 1 and enable the ball to be moved toward the opposite goal by means of the actuating rods moving a dummy player piece 12, 13 or 14 into contact with the ball. While the drawings show a pair of actuating rods 10 and 11 and associated structure only at one end of a game table, it is to be understood that a similar pair of actuating rods and associated structure are also provided at the opposite end of the table for the second player.

According to the invention the bearings 15 and 16 of the actuating rods 10 and 11 are not rigidly mounted relative to the sides of the table as in prior art game tables, but are connected in the area of the ends of each rod 10 and 11 to a sleeve bearing 17 which is freely displaceable in a reciprocating movement along its longitudinal axis on a guide rod 18. Each guide rod 18 is secured by brackets 19 and 20 at its opposite ends to the side of the table. Rubber bumpers 21 and 22, adjacent the brackets 19 and 20, respectively, prevent the sleeve 17 from striking hard against the brackets during its longitudinal movement. A pair of guide rods 18 are connected to the opposite sides of the table at each end of the table and a sleeve bearing 17 is displaceably connected on each guide rod. Plates 23 are welded to the underside of oppositely disposed sleeves 17. The plates 23 of oppositely disposed sleeve bearings 17 are rigidly connected together by means of a connecting rod 24 disposed beneath the playing field and extending at right angles to the sleeves 17. Short sleeve bearings 15 and 16 are welded to the upper side of each sleeve bearing 17 at right angles to their longitudinal axis. These short sleeve bearings 15 and 16 form the bearings for the actuating rods 10 and 11 that carry the dummy player pieces 12, 13 and 14, and the actuating rods 10 and 11 are both axially shiftable and rotatable in these bearings. It is understood that there is a bearing 15 supporting opposite ends of rod 10 and a bearing 16 supporting opposite ends of rod 11. Longitudinal slots 25 in the two opposite longitudinal sides of the table bordering the playing field 1, and longitudinal slots 26 in the longitudinal sides of the case 3 below the plane of the playing field 1, enable the parallel actuating rods 10 and 11 and the connecting rod 24 to be freely displaced with the sleeve bearings 17 in the longitudinal direction of the playing field and parallel to the playing field. The pair of sleeve bearings 17 connected by the connecting rod 24 forms a longitudinally displaceable slide carriage for the actuating rods, which is moved back and forth by gripping the handles of the actuating rods. Simultaneously, the players can selectively rotate the actuating rods 10 and 11 about their longitudinal axes and selectively move the actuating rods axially to bring the dummy player pieces thereon into contact with the ball on the playing field to propel it toward the goal at the opposite end of the playing field.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. A table game comprising a supported playing field, guide means connected with and extending along opposite sides of at least a portion of said playing field, carriage means mounted for longitudinal movement along said guide means, a pair of actuating rod means connected parallel to each other and extending above and laterally of said playing field and movably connected to said carriage means, said pair of actuating rod means spaced from each other in the longitudinal direction of the playing field, and player pieces connected on said pair of actuating rod means and adapted to be moved into contact with and to propel a game piece on the playing field, whereby movement of said carriage means moves said pair of actuating rod means parallel to and longitudinally of the playing field.

2. A table game as set forth in claim 1 in which said guide means comprise two guide rods mounted along opposite sides of said playing field, and extending along the longitudinal sides of the playing field parallel to one another and to the playing field.

3. A table game as set forth in claim 2 in which said carriage means comprises a pair of sleeve members, each sleeve member of said pair mounted for longitudinal displacement along one of said guide rods, a connector extending laterally, beneath said playing field and rigidly connected between said pair of sleeve members, upwardly projecting bearing means connected on said pair of sleeve members at right angles thereto, and said pair of actuating rod means connected for movement in the upwardly projecting bearing means on opposite sleeve members.

4. A table game as set forth in claim 3 in which said pair of actuating rod means comprise a pair of actuating rod members connected for rotation about their axes in said upwardly projecting bearing means, and are spaced further apart from one another on said sleeve members, than the combined radius of movement of the player pieces on the two adjacent actuating rod members.

5. A table game as set forth in claim 2 in which said carriage means includes one sleeve bearing on each longitudinal side of the playing field having the pair of actuating rod means connected thereto and connected for selected, guided, longitudinal movement on a respective guide rod.

6. A table game as set forth in claim 2 in which a pair of guide rods, a carriage means and a pair of actuating rod means are connected at opposite ends of the playing field.

7. A table game as set forth in claim 6 including longitudinally extending side walls and end walls connected around and extending above said playing field, said guide rods connected on the outside of and spaced outwardly from said longitudinally extending side walls, said longitudinally extending side walls having elongated slots therethrough and said actuating rod means projecting through said slots in opposite side walls of the table game.

* * * * *